United States Patent [19]

Foucher

[11] Patent Number: 5,024,581

[45] Date of Patent: Jun. 18, 1991

[54] DEVICES FOR REDUCING DEFLECTION AND STRESS IN TURBINE DIAPHRAGMS

[75] Inventor: Gérard Foucher, Tremblay les Gonesse, France

[73] Assignee: GEC Alsthom SA, Paris, France

[21] Appl. No.: 415,731

[22] Filed: Oct. 2, 1989

[30] Foreign Application Priority Data

Oct. 6, 1988 [FR] France ..... 88 13117

[51] Int. Cl.[5] ..... F01D 9/04

[52] U.S. Cl. ..... 415/191; 415/193; 415/209.2; 415/170.1

[58] Field of Search ..... 415/209.1, 209.2, 209.3, 415/209.4, 211.1, 211.2, 170.1, 174.2, 181, 182.1, 183, 134, 137, 135, 136, 138, 139, 191, 193

[56] References Cited

U.S. PATENT DOCUMENTS

| | | | |
|---|---|---|---|
| 1,154,777 | 9/1915 | Kieser | 415/138 |
| 1,242,578 | 10/1917 | Moore | 415/209.2 |
| 1,352,277 | 9/1920 | Junggren | 415/209.4 |
| 1,549,209 | 8/1925 | Nobs | 415/209.2 |
| 2,905,434 | 9/1959 | Hertl | 415/209.2 |
| 3,021,110 | 2/1962 | Rankin et al. | 415/139 |
| 3,169,748 | 2/1965 | Howard et al. | 415/209.2 |

FOREIGN PATENT DOCUMENTS

| | | | |
|---|---|---|---|
| 13005 | 2/1978 | Japan | 415/170.1 |
| 243974 | 12/1925 | United Kingdom | 415/138 |
| 374783 | 6/1932 | United Kingdom . | |
| 597953 | 2/1948 | United Kingdom | 415/209.2 |
| 702966 | 1/1954 | United Kingdom | 415/191 |
| 767730 | 2/1957 | United Kingdom . | |

*Primary Examiner*—John T. Kwon

*Attorney, Agent, or Firm*—Sughrue, Mion, Zinn, Macpeak & Seas

[57] ABSTRACT

A turbine comprising at least one stage (20) having a diaphragm (1) which is split in two along a diametrical plane and which includes an outer ring (3) and an inner ring (6) interconnected by virtue of (10 and 11) serving to guide the turbine fluid, the downstream face (14) of the outer ring (3) being pressed against a ring (19) of the turbine stator (4), the diaphragm (1) being provided with sealing (17) providing sealing between the outer ring (3) and the stator (4), the turbine being characterized in that the sealing (17) are disposed on the outer edge (15) of the outer ring (3), in that the downstream face (14) of the outer ring (3) is provided with a land (18) at a distance from the outer edge (15) and bearing against the ring (19) of the stator (4), and in that communication (22, 27, 27') are provided for providing communication between the space (25) situated between the land (18) and the sealing (17), and a space downstream from the diaphragm (1) with the pressure in the space being less than the pressure $P_1$ existing over the upstream face (26) of the diaphragm (1).

6 Claims, 9 Drawing Sheets

DEVICES FOR REDUCING DEFLECTION AND STRESS IN TURBINE DIAPHRAGMS

STATE OF THE PRIOR ART

In a turbine stage, the diaphragm (FIG. 1) enables the fluid to expand either completely (an impulse turbine) or partially (a reaction turbine) prior to passing through the bladed wheel in which energy is transferred to the rotor.

The diaphragm is a major component in that it performs the following functions:

it expands the fluid through the director vanes with best efficiency;

it supports sealing devices both at the peripheries of the bladed wheels and at the hub of the rotor;

it keeps the director vanes radially positioned relative to the wheel blades under all operating circumstances; and it withstands the pressure difference between its upstream and downstream faces without subjecting the mechanical parts to major deflections and stresses. In this context, it should be understood that major deflections in the axial direction of the turbine give rise to large axial clearances and to a loss of efficiency in the stage.

In general, a diaphragm is constituted (see FIG. 1):

either by distributor vanes which serve both to guide and to expand the fluid passing therebetween, and providing the connection between the outer binding of the diaphragm and its center;

or else by a distributing grid which serves to guide and expand the fluid passing therethrough and which is associated with arms (or bridges) on its upstream side that provide the mechanical connection between the outer binding of the diaphragm and its center.

The split in the diaphragm on a diametrical plane as is required for assembly purposes constitutes a source of high stresses in the bridges and the vanes situated in the vicinity thereof. Similarly, deflections are greater close to the plane of the split than they are in the plane of symmetry perpendicular thereto.

In order to reduce stresses and deflections in a diaphragm, the thickness of the diaphragm may be increased, thereby increasing the length of the machine in which the diaphragms are disposed.

OBJECT OF THE INVENTION

In order to avoid increasing the thickness of the diaphragms, the inventor has had the idea of changing the distribution of forces over the upstream face of the outer ring of the diaphragm.

FEATURES OF THE INVENTION

The invention enabling this objective to be achieved is characterized in that:

the sealing means between the diaphragm and the stator in which it is received are disposed on the outer edge of the outer ring;

the downstream face of said outer ring is provided with a bearing surface or "land" distant from its outer edge and bearing against the ring of the stator;

means are provided for ensuring communication between the space situated between the land and the sealing means and a space downstream from the diaphragm, said space being at a pressure which is lower than the pressure $P_1$ existing over the upstream face of the diaphragm;

said space is at the downstream pressure $P_2$ of the stage ($P_2 < P_1$) so that forces develop thereat which are applied against the ring at points which are further from the axis of the diaphragm than is the land; and the reduction of the stress in the connection means between the center and the binding of the diaphragm makes it possible to reduce the deflections of the central portion of the inner ring, thereby reducing axial clearances and increasing the efficiency of the stage.

In a first embodiment of the invention, the means providing communication are constituted by slots provided through the land thus putting the space situated between the land and the sealing means to the downstream pressure $P_2$ of the stage including the diaphragm.

In a second embodiment of the invention, the communication means are constituted by openings provided through the stator ring against which the land bears, thereby putting the space situated between the land and the sealing means to the downstream pressure $P_2$ of the moving stage following the stage with the diaphragm.

In a third embodiment of the invention, the space situated between the land and the sealing means are connected via ducts to one of the further downstream stages of the machine which is naturally at a pressure P which is less than the pressure $P_2$.

In an improvement of the invention, the outer ring of the diaphragm includes a larger diameter portion having the sealing means disposed on the outer edge thereof. As a result, the force applied against the upstream portion of the ring is increased.

The larger diameter portion may be received between the stator-fixing bolts.

In another improvement of the invention, the space situated upstream from the sealing means for the outer edge of the outer ring of the diaphragm of one of the preceding stages.

BRIEF DESCRIPTION OF THE DRAWINGS

Embodiments of the invention are described by way of example with reference to the accompanying drawings, in which.

MORE DETAILED DESCRIPTION

Figure 1:
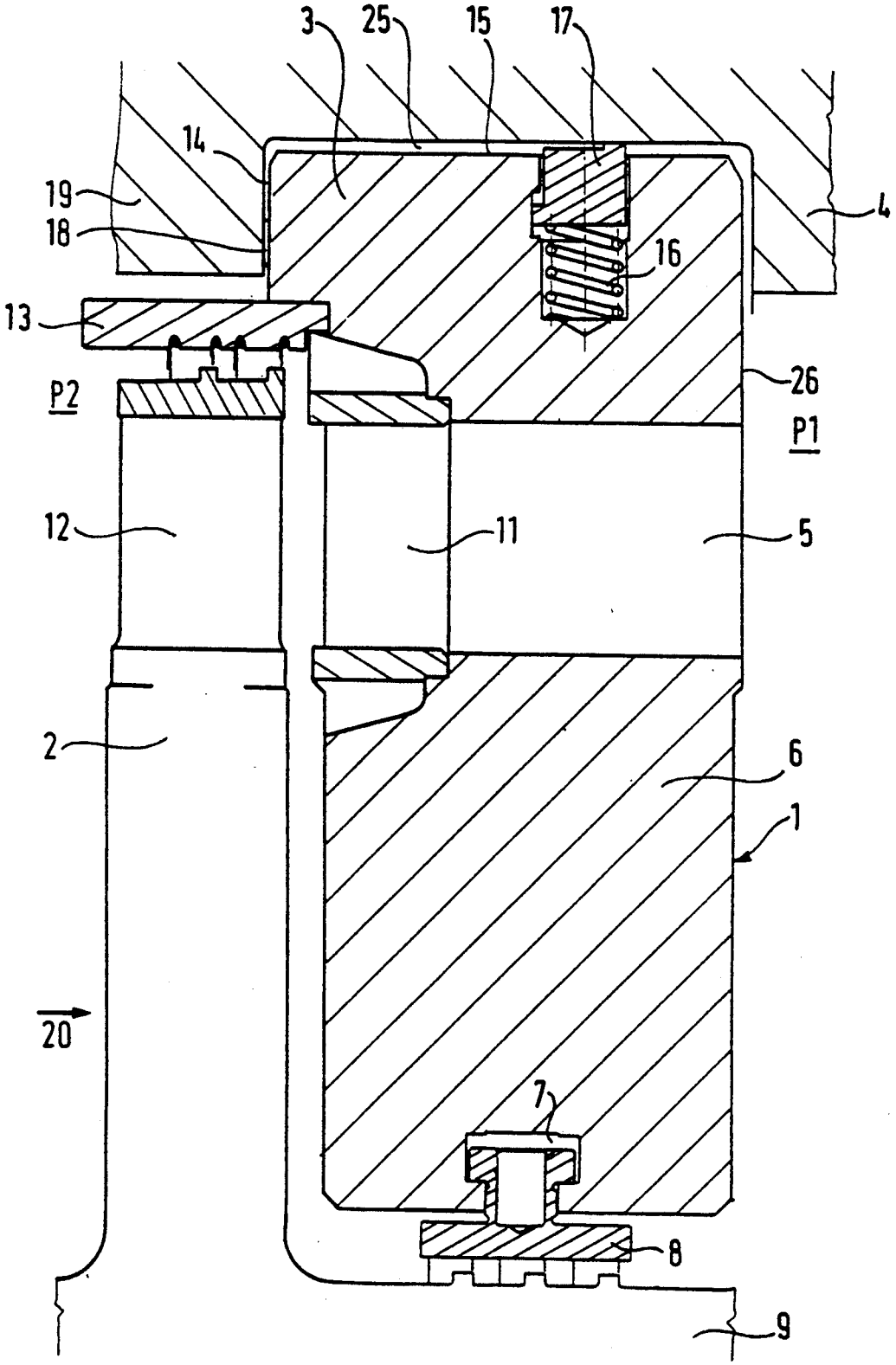
FIG. 1 is a cross section through a stator diaphragm taken on a plane including the turbine axis.

The invention is now described in greater detail in action relative to vanes 12 of the moving wheel 52 forming a portion of the rotor 9. Sealing devices 13 are fixed on the upstream face 14 of the diaphragm 1 and surround the moving wheel 2.

On the outer edge 15 of the outer ring 3 there is a sealing device 17 which is received in a groove 16 and which is pressed by a spring 16 against the inside wall of the stator in order to form a seal.

A circular land 18 is disposed on the upstream face 14 of this outer ring 3 and bears against a ring 19 of the stator 4 situated around the wheel 2 and the sealing devices 13.

The land 18 is situated as close as possible to the device 13.

Figure 2:
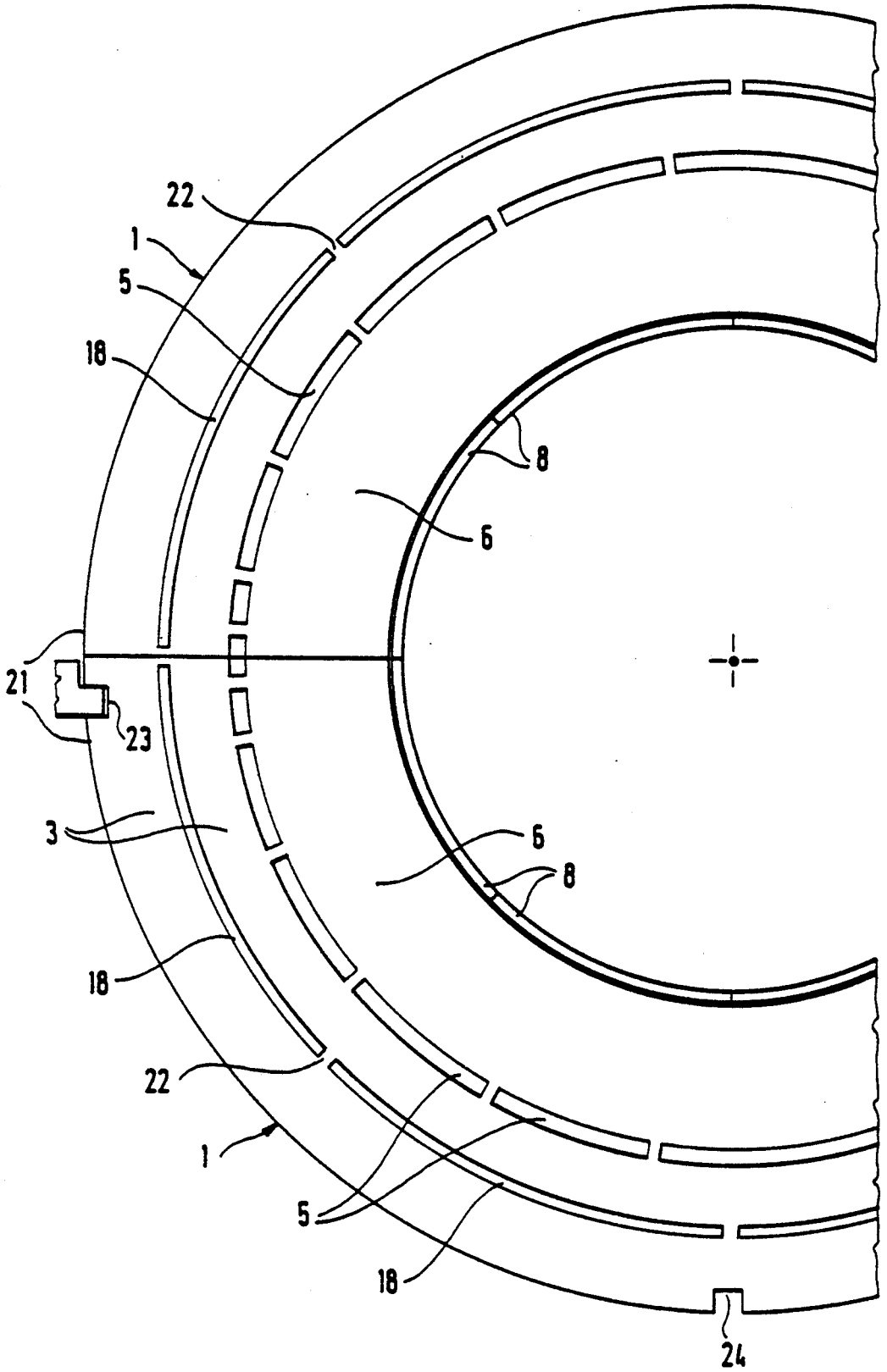
FIG. 2 is an elevation view of the diaphragm shown in FIG. 1.
Figure 3:
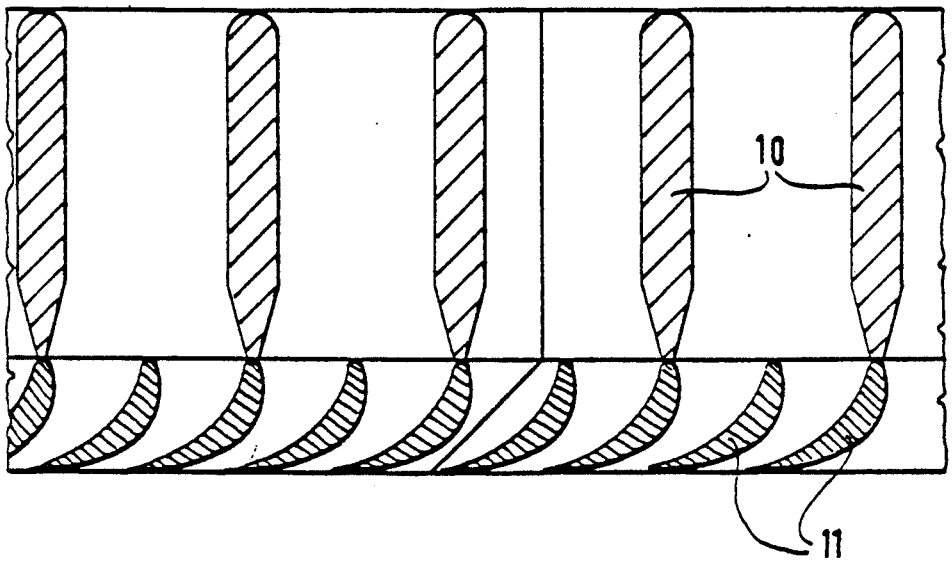
FIG. 3 is a circumferential section through a portion of a stator and the adjacent portion of a rotor.

The land is provided with slots 22 (see FIG. 2).

The periphery of the diaphragm 1 is provided with two notches 23 in the vicinity of the join plane, and one notch 24 at the bottom.

In conventional manner, the notches 23 receive keys which suspend the diaphragm 1 within the stator 4.

The notch 24 also receives in conventional manner a key which provides additional guidance and which, together with the keys in the notches 23, provides an assembly which is free to expand.

The space 25 situated between the sealing means 17 and the land 18 is put into communication with the pressure $P_2$ existing downstream from the wheel 2 by means of the slots 22.

Since the pressure $P_1$ existing upstream from the diaphragm is greater than the pressure $P_2$, a force is applied around the upstream face 26 of the top ring 3, and as a result a lever effect about the land 18 causes the stresses in the vanes 11 and the bridges 10 of the steam channel 5 to be reduced. Likewise, the maximum deflection situated in the join plane and close to the hub of the rotor is reduced.

Figure 4:
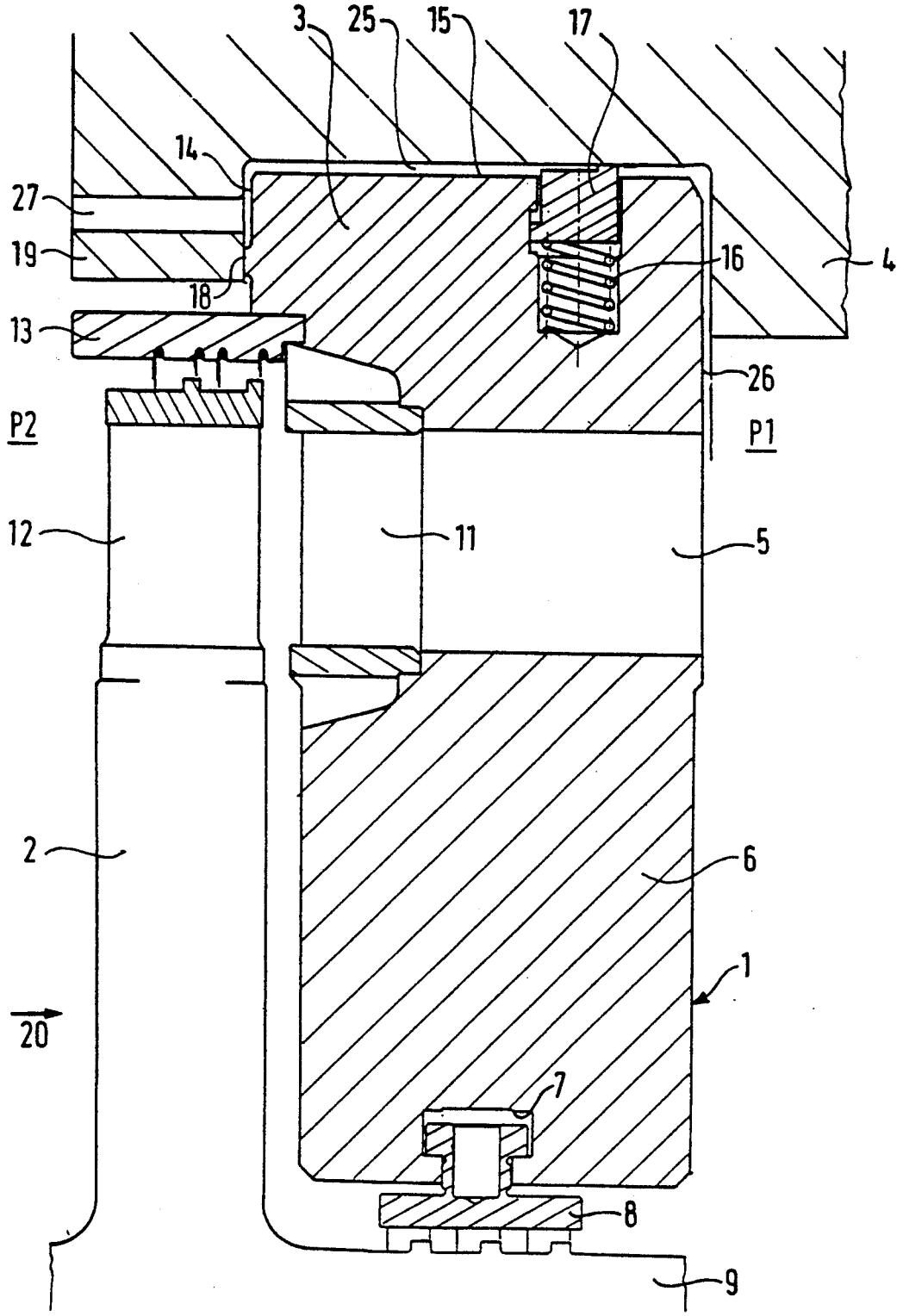
FIGS. 4 to 9 are views similar to FIG. 1 through various different embodiments of the invention.

In a variant of the invention shown in FIG. 4, the land 18 no longer includes slots as in the FIG. 1 embodiment, but provides a seal against the ring 19 of the stator 4.

The ring 19 is provided with through openings which put the space 25 between the sealing means 17 and the land 18 into communication with the downstream side of the stage 20 at pressure $P_2$.

Figure 5:
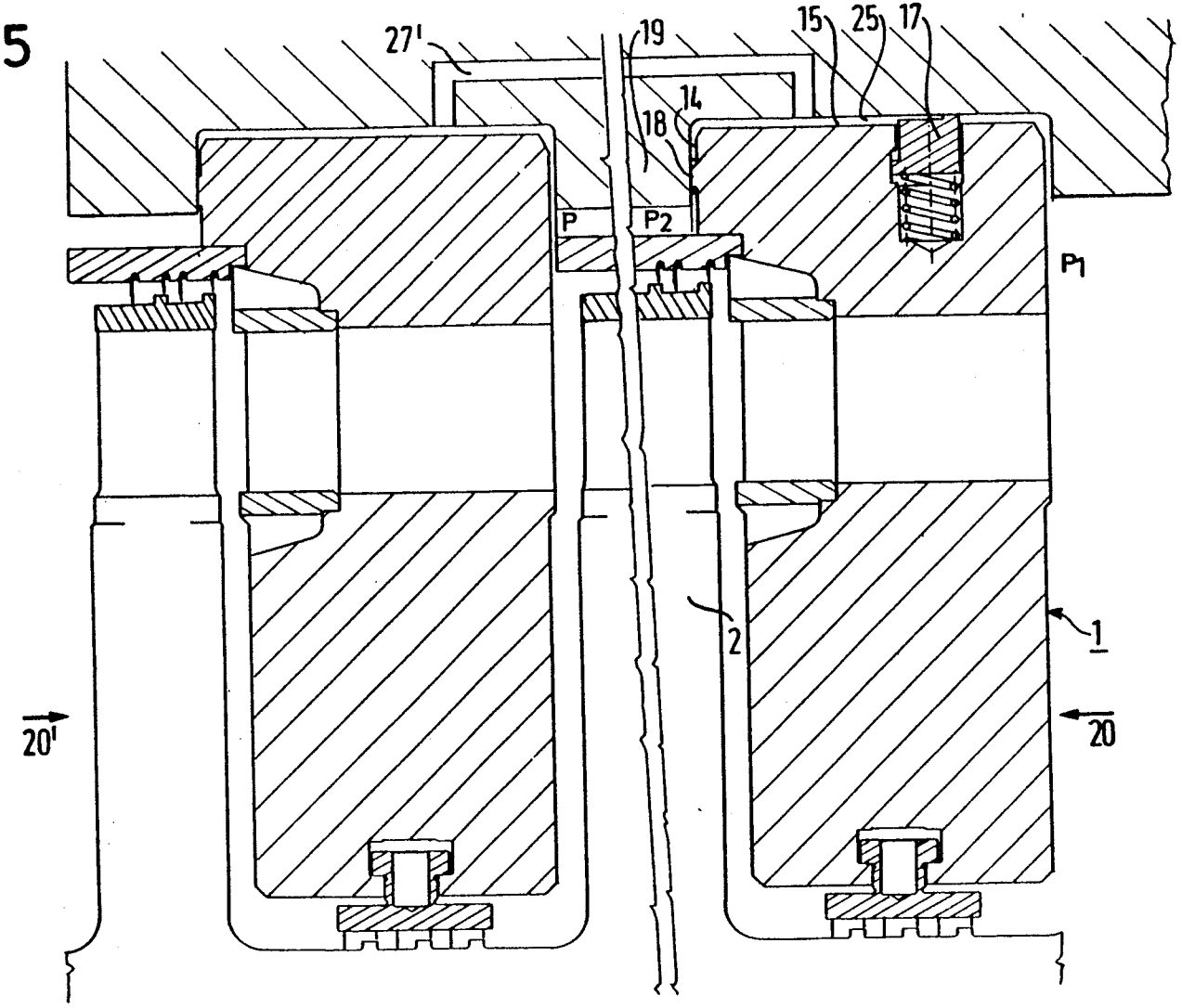

In another variant, shown in FIG. 5, the land 18 likewise makes a seal with the ring 19, and the space 25 between the sealing means 17 and the land 18 is put into communication via a duct 27' with one of the following stages 20' in which the pressure P is naturally less than the pressure $P_2$ which is established at the outlet from the stage 20.

Figure 6:
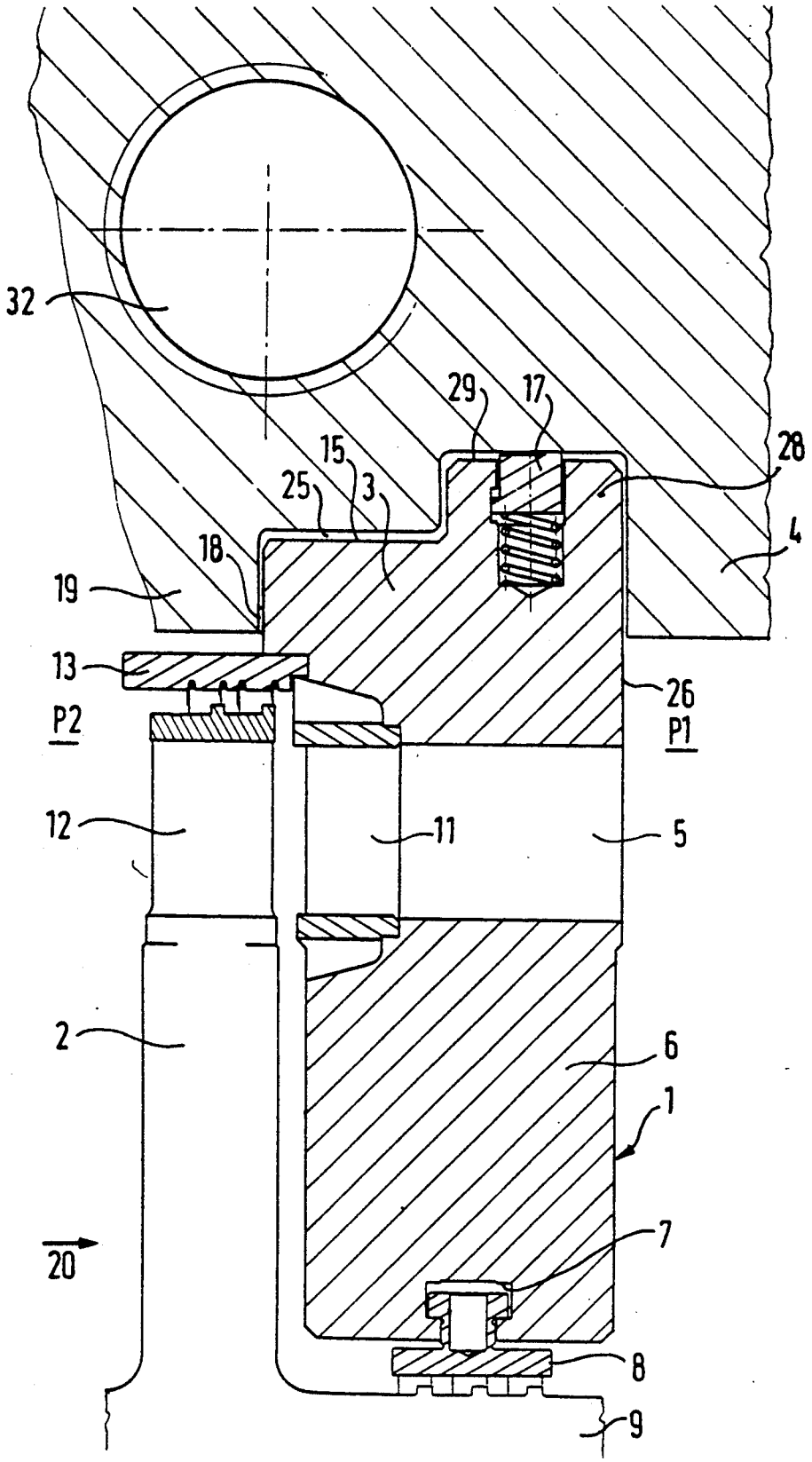

In FIG. 6, a third variant is shown in which the outer ring 3 includes a larger diameter portion 28 on its outer edge 29 receiving the sealing means 17. This larger diameter portion is of a thickness such as to be capable of being received between the bolts 32 which are used for bolting the stator 4 together.

The space 25 between the land 18 and the sealing means 17 is put into communication with the immediately downstream space of the stage 20 via slots 22 provided through the land 18. It would also be possible to use openings 27 as shown in FIG. 4 for this communication, or any other ducting putting the space 25 into communication with a space existing downstream from the stage 20 and in which the pressure is less than the pressure $P_2$ which is established at the outlet from the wheel 2.

Thus, without increasing the size of the stator, it is possible to have a force on the upstream face 26 of the outer ring 3 which is greater than the force in the embodiments of FIGS. 1 and 4.

Figure 7:
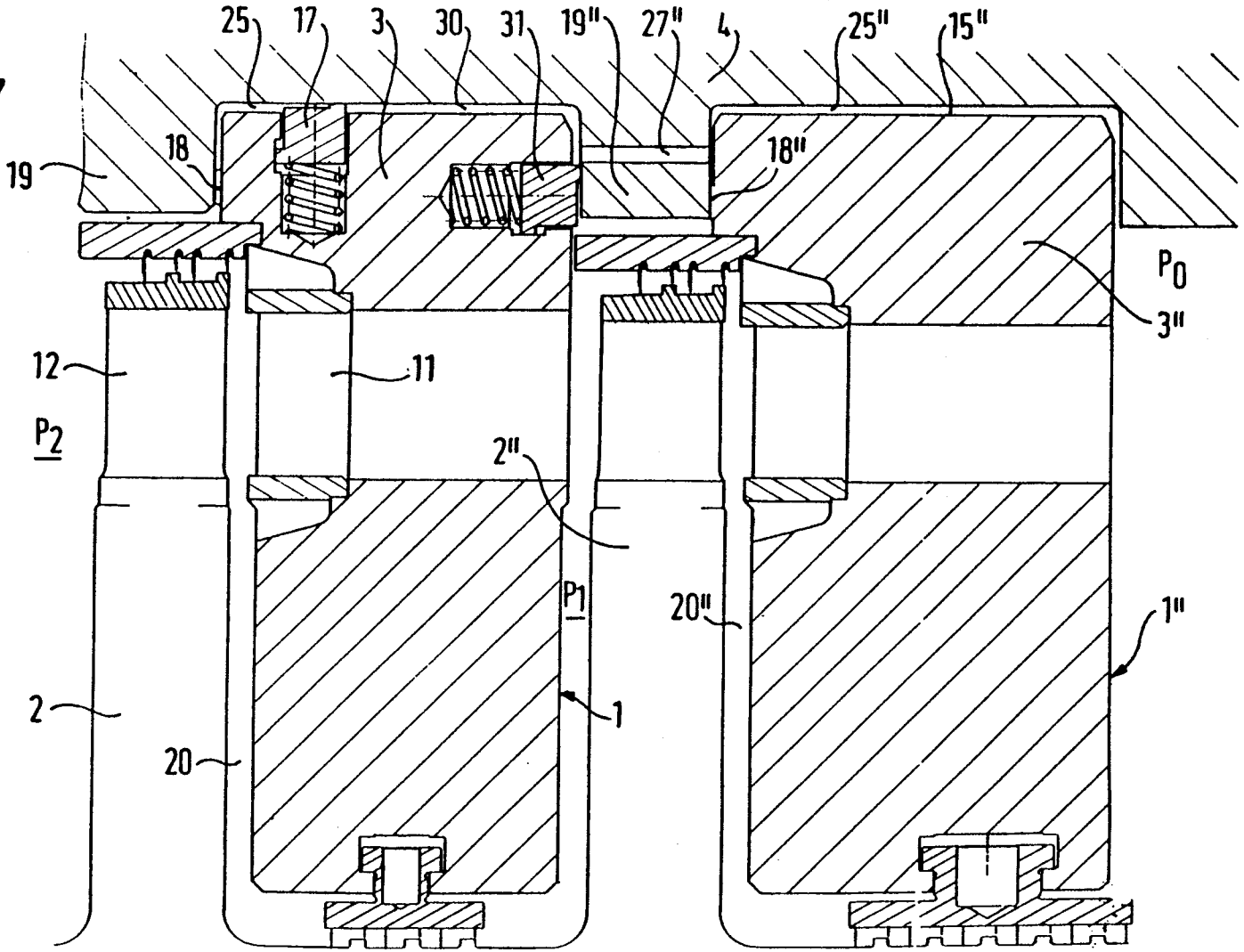

FIG. 7 shows a fourth variant of a turbine of the invention.

The stage 20 is identical to that shown in FIG. 1.

However, the upstream face 26 of the diaphragm 1 includes second sealing means 31 at a distance from the outer edge 15 and bearing against the ring 19'' of the stator situated around the moving wheel 2'' of the preceding stage 20''.

The diaphragm 1'' of the preceding stage is similar to that shown in FIG. 4 and includes a circular land 18'' bearing in sealed manner against the ring 19'' of the stator. However, it does not include sealing means against the outer edge 15'' of the outer ring 3''. Thus, the space 15'' between the stator 4 and the diaphragm 1'' upstream from the land 18'' is at the pressure $P_0$ upstream from the diaphragm 1'', whereas the space 25 is at the downstream pressure $P_2$ of the stage 20.

The ring 19'' is provided with openings 27'' putting the space 25'' into communication with the space 30 situated between the sealing means 17 and the second sealing means 31. Since the pressure difference $P_0-P_2$ is greater than the pressure difference $P_1-P_2$, the force generated around the upstream face 26 of the outer ring 3 is greater.

Figure 8:
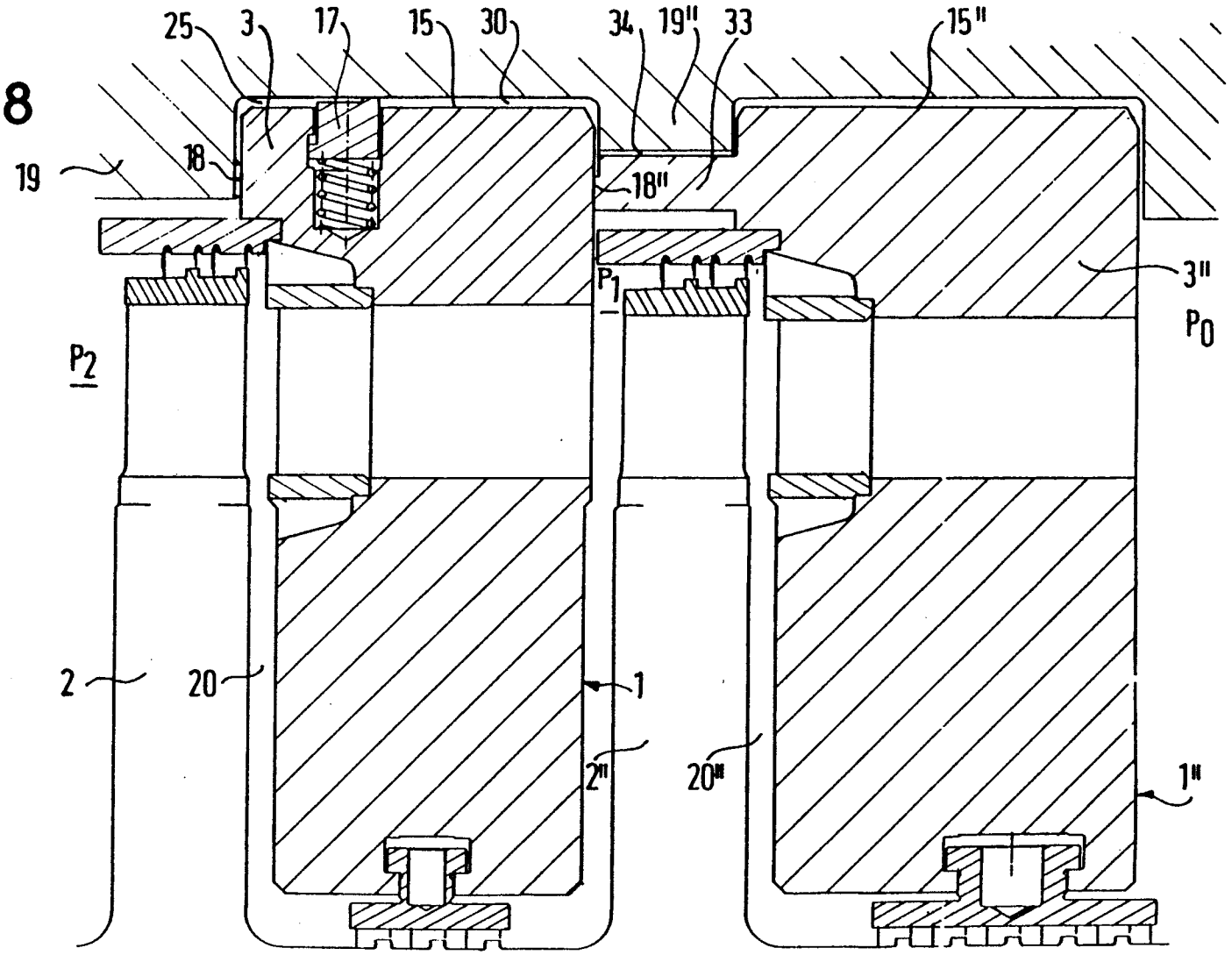

A variant of the FIG. 7 device is shown in FIG. 8, in which the ring 19'' situated above the moving wheel 2'' of the preceding stage 20'' is narrower and surrounds a ring 33 integral with the diaphragm 1''. This ring 33 is terminated by a land 18'' which bears in sealed manner against the diaphragm 1.

By virtue of the passage 34 left free between the ring 33 and the ring 19'', the space 30 lying between the sealing means 17 and the land 18'' is kept at the upstream pressure $P_0$ of the diaphragm 1'' of the preceding stage 20''.

The diaphragm 1 having stress correction may be thinner than the diaphragm 1'' in which stress is not corrected.

Figure 9:
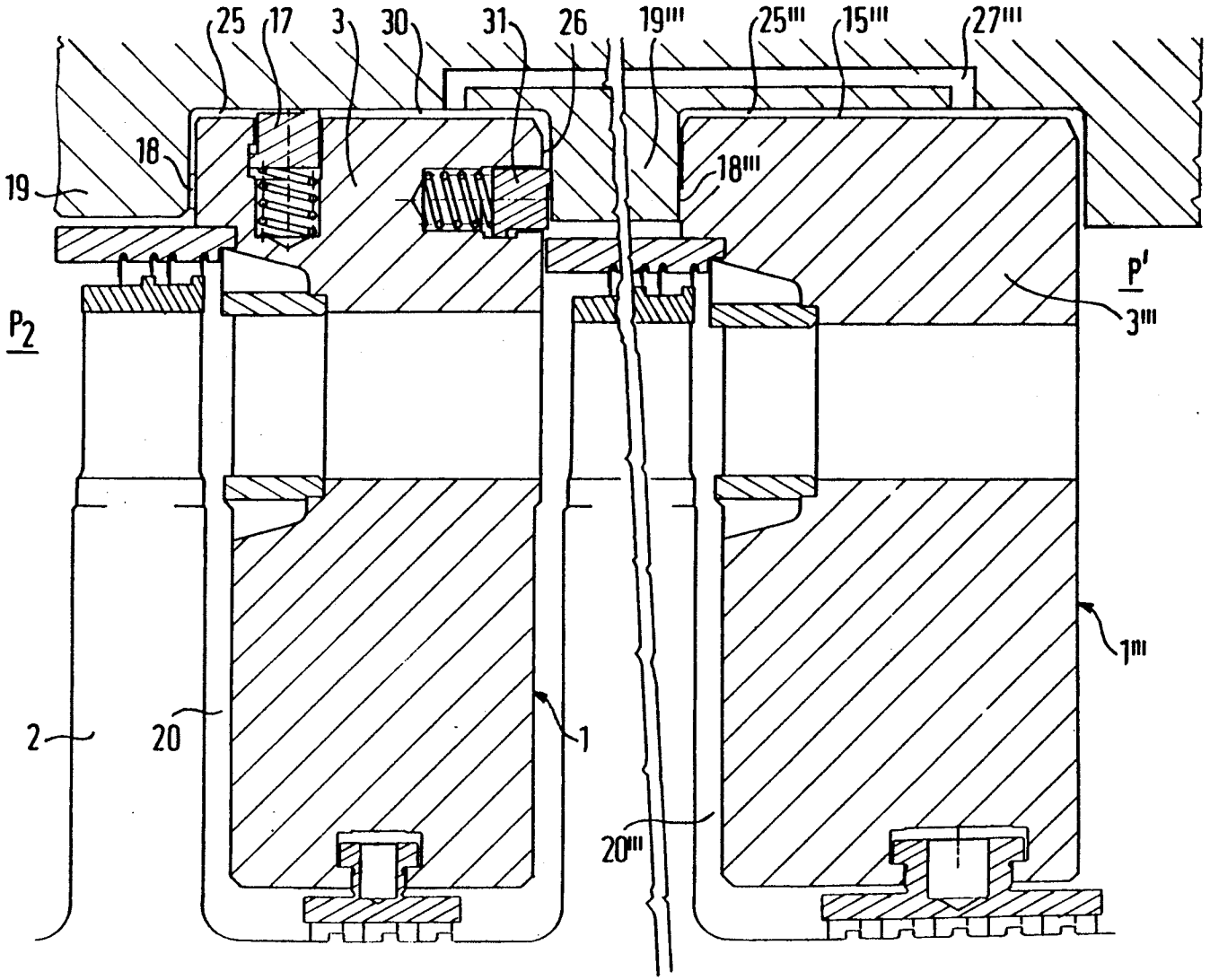

In another variant of the FIG. 7 device and as shown in FIG. 9, the stage 20 is identical to that of FIG. 7.

Instead of being connected to the space 25'' which contains the pressure $P_0$ upstream from the diaphragm 1'' of the preceding stage, the space 30 is connected via a communication 27''' to a space 25''' of one of the earlier stages 20''' in which the pressure P' is greater than the pressure $P_0$.

The force exerted on the upstream face 26 of the diaphragm 1 is thus greater than that exerted in the device of FIG. 7 since the difference $P'-P_2$ is greater than $P_0-P_2$.

I claim:

1. A turbine comprising at least one stage having a diaphragm which is split in two along a diametrical plane and which includes an outer ring and an inner ring interconnected by means serving to guide the turbine fluid, a downstream face of the outer ring being pressed against a ring of the turbine stator, said diaphragm being provided with sealing means providing sealing between the outer ring and the stator, wherein said sealing means are disposed on the outer edge of the outer ring, wherein the downstream face of said outer ring is provided with a land at a distance from the outer edge and bearing against the ring of the stator, and wherein communication means are provided for providing communication between the space situated between the land and the sealing means, and a space downstream from the diaphragm with the pressure in said space being less than the pressure $P_1$ existing over the upstream face of the diaphragm.

2. A turbine according to claim 1, wherein said communication means are constituted by slots provided through the land.

3. A turbine according to claim 1, wherein said communication means are constituted by openings provided through the ring of the stator against which the land bears.

4. A turbine according to claim 1, wherein the communication means are constituted by ducts providing communication between said space and a stage downstream from the stage and in which the pressure P is less than the pressure $P_2$ existing downstream from the stage.

5. A turbine according to claim 1, wherein the outer ring of the diaphragm includes a larger diameter portion on the outer edge thereof and on which the sealing means are disposed.

6. A turbine according to claim 1, wherein the space situated upstream from the sealing means on the outer edge of the outer ring of the diaphragm is isolated from the pressure $P_1$ which exists upstream from the diaphragm by second sealing means situated on the upstream face of the diaphragm at a distance from the outer edge, and wherein means are provided for communicating said space with one of spaces upstream from the preceding stage in which the pressure is greater than the pressure $P_1$.

* * * * *